US010987707B2

(12) United States Patent
Saltykov et al.

(10) Patent No.: US 10,987,707 B2
(45) Date of Patent: Apr. 27, 2021

(54) COMBINED METHOD FOR CLEANING A TUBING STRING AND APPARATUS FOR CARRYING OUT SAID METHOD

(71) Applicant: ILMASONIC-SCIENCE LIMITED LIABILITY COMPANY, Moscow (RU)

(72) Inventors: Alexandr Alexeevich Saltykov, Schelkovo (RU); Yuriy Alexeevich Saltykov, Moscow (RU); Andrey Alexandrovich Rukhman, Moscow (RU)

(73) Assignee: ILMASONIC-SCIENCE LIMITED LIABILITY COMPANY, Moscow (RU)

( * ) Notice: Subject to any disclaimer, the term of this patent is extended or adjusted under 35 U.S.C. 154(b) by 136 days.

(21) Appl. No.: 16/342,224

(22) PCT Filed: Nov. 15, 2017

(86) PCT No.: PCT/RU2017/050117
§ 371 (c)(1),
(2) Date: Apr. 16, 2019

(87) PCT Pub. No.: WO2018/093299
PCT Pub. Date: Mar. 24, 2018

(65) Prior Publication Data

US 2019/0240708 A1 Aug. 8, 2019

(30) Foreign Application Priority Data

Nov. 17, 2016 (RU) ..... RU2016145127

(51) Int. Cl.
*E21B 37/02* (2006.01)
*E21B 28/00* (2006.01)
(Continued)

(52) U.S. Cl.
CPC ..... *B08B 9/0436* (2013.01); *B08B 3/12* (2013.01); *B08B 9/027* (2013.01); *E21B 28/00* (2013.01);
(Continued)

(58) Field of Classification Search
CPC ..... E21B 28/00; E21B 37/02; E21B 37/00
See application file for complete search history.

(56) References Cited

U.S. PATENT DOCUMENTS 5,595,243 A * 1/1997 Maki, Jr. ..... B08B 3/12 166/177.2
5,727,628 A * 3/1998 Patzner ..... E21B 28/00 166/177.2
(Continued)

FOREIGN PATENT DOCUMENTS

RU 2312206 C1 12/2007
RU 2495232 C1 10/2013
(Continued)

*Primary Examiner* — Kenneth L Thompson
(74) *Attorney, Agent, or Firm* — Nixon & Vanderhye P.C.

(57) ABSTRACT

The group of inventions relates to the oil-and-gas extraction industry, in particular to equipment for removing deposits of asphaltenes, resins, paraffins, hydrates, calcium salts, etc. from tubing strings of oil and gas wells without extracting said tubing strings from the wells. This instrument can also be used for cleaning water-extracting wells and other wells. The internal surface of a tubing string is cleaned by a combined action (ultrasonic, mechanical, heat) on contaminants. Owing to the fact that operation of a well does not stop, dirt atomized by the combined action is raised to the surface and removed from the well by a stream of fluid. A system for ultrasonic cleaning of a tubing string consists of an ultrasonic generator and a downhole ultrasonic scraper, which comprises a converter converting electrical vibrations into mechanical vibrations, which is placed into a protective casing and is connected to a vibration transformer, which
(Continued)

boosts the amplitude of vibrations of ultrasonic transducers. The use of the claimed group of inventions makes it possible to increase the efficiency and economy of an operation for cleaning a tubing string.

12 Claims, 2 Drawing Sheets

(51) Int. Cl.
*B08B 9/043* (2006.01)
*B08B 3/12* (2006.01)
*B08B 9/027* (2006.01)

(52) U.S. Cl.
CPC ..... *E21B 37/02* (2013.01); *B08B 2209/005* (2013.01)

(56) References Cited

U.S. PATENT DOCUMENTS

| | | | | |
|---|---|---|---|---|
| 6,474,349 | B1 * | 11/2002 | Laker | B08B 7/028 134/168 C |
| 7,264,056 | B2 | 9/2007 | Towler | |
| 9,243,477 | B2 * | 1/2016 | Solenthaler | E21B 43/003 |
| 9,580,997 | B2 * | 2/2017 | Levitov | E21B 47/00 |
| 9,988,877 | B2 * | 6/2018 | Abramova | B06B 3/00 |

FOREIGN PATENT DOCUMENTS

| | | | |
|---|---|---|---|
| RU | 2495995 | C1 | 10/2013 |
| RU | 2524581 | C1 | 7/2014 |
| RU | 2527549 | C1 | 9/2014 |

* cited by examiner

COMBINED METHOD FOR CLEANING A TUBING STRING AND APPARATUS FOR CARRYING OUT SAID METHOD

TECHNICAL FIELD OF THE INVENTION

The group of inventions relates to the field of oil and gas production. More specifically, the present invention relates to the equipment for pump-compressor pipe (tubing) cleaning of oil and gas wells from deposits of asphalts, resins, paraffins (ARPD), hydrates, salts, calcium, etc. without removing the tubing from wells. This device can also be used for treatment of water production wells and other wells.

BACKGROUND OF THE INVENTION

ARPD in the tubing reduce well productivity, increase equipment wear, energy consumption and pressure in the flow lines. Therefore, the struggle against ARPD is an urgent task with the intensification of oil production. Removal of ARPD is accomplished by means of cleaning the tubing surface and equipment by mechanical scrapers, thermal and chemical well treatment.

The tubing cleaning is also produced during major workovers or well servicing by means of its pulling from the well and carrying out cleaning and inspection by repair services. But the pulling and the subsequent hauling down of the tubing is rather a laborious process, which, in addition to the time and cost, entails the tubing life loss (thread galling). And removing the tubing from free-flow and gas-lift wells is impractical, especially in offshore wells, since it entails the suspending of oil production. So, the less the tubing will be removed from the well the lower production will cost. It is especially true for fields with high viscosity and paraffin oil where the tubing requires cleaning once a month and sometimes more often.

The primary tubing cleaning method that today is used to clean tubing without their removal from wells and without the suspending of oil production—is a mechanical one, and the main one—the scraper method. Therefore, the development of this mechanical cleaning field comprises the number of patents [1-9].

The equipment for implementation of the method structurally consists of a hoist with a drum connected to a motor, a cable fixed to the drum and passing through the system of rollers into the tubing with a scraper and a load attached to the cable end. The cleaning method consists in the sequential lowering and lifting up the scraper (system of scrapers, cutters) in the tubing, during which scrapers clean off the ARPD from the inner surface of the tubing.

The major efforts in the development of the known devices under consideration [1-9] are aimed to create a system of scrapers, which provides reduction of cutting resistance, cutting exertion, improvement in the quality of treatment, the conditions for the removal of sheared sediments and decreasing the probability of emergency situations.

The technical result of these devices is achieved by creating scrapers of special configuration [1, 6], supplying the system with electroheating to melt ARPD for facilitating its removal [4], using special scraper control and management systems [2, 3, 5], using the power of oil flow through the tubing to improve the scrapers efficiency [7], using the power of compressed air or liquid to give the scrapers rotary-translational movement [8, 9].

However, all methods of cleaning using scrapers of various configurations share the same disadvantages: scrapers often get stuck, the cable on which they fall gets cut off, and it results in pulling up the tubing and the increase of well costs.

Besides when using scrapers there remains a layer of ARPD equal to the difference between the inner diameter of the tubing and a diameter of scraper blades (cutters) which is 3-4 mm, so scrapers cannot make a perfectly clean and smooth surface. It is known from physics that the accumulation of sediments increases with increasing surface roughness. It is found that the higher the surface roughness, the more intense deposition of ARPD. At the same time on a smooth surface sediments are negligible, therefore, the cleaner processed surface, the longer the period between cleanings of the tubing, therefore, it reduces costs for well operation. Scrapers also cut large pieces of ARPD, the removal of which requires a powerful stream of fluid rising up in the tubing (which is always present in the running wells). If the flow is weak, then the elements of the ARPD will fall down to the bottom (at the free-flow or gas-lift operation) or to the pump outlet attached to the end of the tubing. In the first case, after several cycles the bottom hole will be clogged, and cleaning products may block the perforation zone. In the second case the engine will be put out of action. In both cases, the extraction of the tubing from the well will be needed as well as cleaning of blockages, which increases operating costs.

There is a known device and cleaning method [8] adopted as the prototype. With this method of cleaning, acoustic oscillations of the fluid create longitudinal and torsional vibrations of the cleaning head, which clean paraffin deposits by cutting elements of the cleaning head and the acoustic fluctuations of fluid. The device comprises a hollow housing with input and output channels, on the outer side of which is mounted a gasket, a spring-loaded cleaning head connected to the front of the housing, the ball is set into a gap with the possibility of its oscillations excitation. In the cleaning head there is made a toroidal chamber. The head is planted on the axis, is integral with the housing and provided with a ledge, which is interconnected with the bore, in the form of a cleaning head groove. The pumped liquid coming to the housing excites the vibrations of the ball. Vibrating motion of the ball creates a pulsating fluid flow. The flow entering the cleaning head, generates acoustic vibrations of high frequency. The ball, when pumping the washing liquid works like a vibrator that creates the pulsating fluid, due to this, the ball moves the device translationally, the fluid generates acoustic oscillations in the cleaning head while running through a toroidal chamber. (see Patent No. RU 2524581 PIPE INNER SURFACE CLEANER, 2013).

In the device description, the frequency of acoustic oscillations of the liquid is not described, so it is not clear what role is played by the acoustic oscillations. Apparently, there is just pulsing liquid involved in the treatment along with cleaning by the cutting elements of the head. It is not clear how the device descends in the tubing and how it is retrieved from it. For operation of the device the energy of the washing liquid is used, therefore, on the surface there must be a pump unit that could create a corresponding pressure. Thus, the device is more energy-intensive than conventional scrapers discussed above. The quality of cleaning will not materially differ from the quality of cleaning by conventional scrapers. Generally, the device is a piston moved by pressure of the washing fluid down the tubing. This means that there is no liquid flow upward which would bring elements of ARPD from the well, so they will settle down and create the problems described above. Large deposits of ARPD on the tubing string may lead to clogging of tubing elements by ARPD and subsequent jamming of the device under discussion in the pipe that will create an emergency situation.

SUMMARY OF THE INVENTION

The problem solved by the claimed group of inventions is to clean the surface of tubing, contributing to an increase of the period between treatments, with the possibility to treat tubing without suspending of the oil production and without creating emergency situations. This is especially useful for wells with free-flow and gas-lift methods of production, and the wells equipped with sucker-rod pumps.

The technical result of the proposed technical solution is to increase the effectiveness and cost-efficiency of tubing cleaning.

Effectiveness refers to a quality of cleaning of the tubing surface, contributing to an increase in the period between treatments, the ability to treat the tubing without suspending the oil production and without creating emergency situations. This is especially useful for wells with free-flow and gas-lift methods of production, and the wells equipped with sucker-rod pumps.

The cost-efficiency of the operation refers to the reduction in the cost of cleaning the tubing and reducing the operating costs of the well in general.

The technical result of the claimed technical solution is achieved due to creation of the method for cleaning pump-and-compressor tubing from asphalt-resin-paraffin deposits and hydrates in a running well, the method comprising: lowering a downhole ultrasonic scraper down to a point of clogging in the running well, wherein the scraper is connected by means of a geophysical cable to a ground-based ultrasonic generator, and lowering is performed by means of a logging hoist through a borehole sealer or lubricator; activating the ultrasonic generator and carrying out a combined triple ultrasonic, heat and contact action on the asphalt-resin-paraffin deposits and hydrates, wherein the contact action on the asphalt-resin-paraffin deposits and hydrates is performed via shock vibrations by an ultrasound transducer with a frequency of 15-30 kHz, the ultrasonic and heat impact on the asphalt-resin-paraffin deposits and hydrates is carried out with an intensity of more than 0.1 W/cm2; continuing oil production and extracting the asphalt-resin-paraffin deposits and hydrates from the running well by a fluid stream.

In a specific case of implementation of the claimed technical solution the location of clogging is determined by the amount of slackening of the geophysical cable.

The claimed technical result is also achieved due to the fact that the device for a combined tubing cleaning from asphalt-resin-paraffin deposits comprises a surface ultrasonic generator, a logging hoist, a downhole ultrasonic scraper connected by a geophysical cable to a surface ultrasonic generator, while downhole ultrasonic scraper contains a converter of electrical oscillations into mechanical oscillations, an oscillation transformer connected to a converter of electrical oscillations into mechanical oscillations, an ultrasonic transducer, connected to an oscillation transformer, wherein a converter of electric oscillations is mounted inside a protective casing made with holes, and under a protective casing there is placed a temperature sensor.

In a specific case of implementation of the claimed technical solution a converter of electrical oscillations into mechanical oscillations is made of piezoceramic type.

In a specific case of implementation of the claimed technical solution a converter of electrical oscillations into mechanical oscillations is made of magnetostrictive type.

In a specific case of implementation of the claimed technical solution an ultrasonic transducer is connected to an oscillation transformer by means of threaded connection.

In a specific case of implementation of the claimed technical solution an ultrasonic transducer is made in the shape of a mushroom.

In a specific case of implementation of the claimed technical solution an ultrasonic transducer is made in the shape of a bell.

In a specific case of implementation of the claimed technical solution an ultrasonic transducer is made in the shape of a short cylinder.

In a specific case of implementation of the claimed technical solution a downhole ultrasonic scraper is made with the power of 1 kW and a diameter of the ultrasonic transducer of 50 mm.

In a specific case of implementation of the claimed technical solution a downhole ultrasonic scraper is made with the power of 3 kW and a diameter of the ultrasonic transducer of 80 mm.

In a specific case of implementation of the claimed technical solution a downhole ultrasonic scraper is made with the power of 5 kW and a diameter of the ultrasonic transducer of 110 mm.

BRIEF DESCRIPTION OF THE DRAWINGS

Details, features and advantages of the present invention result from the following description of ways to realize the claimed technical solution and the drawings showing:

In the figures the parts are marked by numerals as follows:

1—converter of electrical oscillations into mechanical oscillations; 2—oscillation transformer; 3—ultrasonic transducer (nozzle) in the shape of a mushroom; 4—ultrasonic transducer (nozzle) in the shape of a bell; 5—ultrasonic transducer (nozzle) in the shape of a short cylinder; 6—terminal; 7—casing; 8—geophysical cable; 9—lubricator; 10—ultrasonic generator; 11—downhole ultrasonic scraper; 12—tubing; 13—packer.

DETAILED DESCRIPTION OF THE INVENTION

The device for combined tubing cleaning consists of two main parts: a ground-based ultrasonic generator and a downhole ultrasonic scraper (DUS). Hereafter, in the present application the name of this device will be: a complex for ultrasonic pipe cleaning (CUPC).

Ultrasonic generator (10) has no distinguishing features and is similar to any other generator operated with downhole magnetostrictive or piezoceramic transducers. Ultrasonic generator (10) is connected to the downhole ultrasonic scraper via geophysical cable (8) wound on a drum of a logging hoist.

Figure 1:
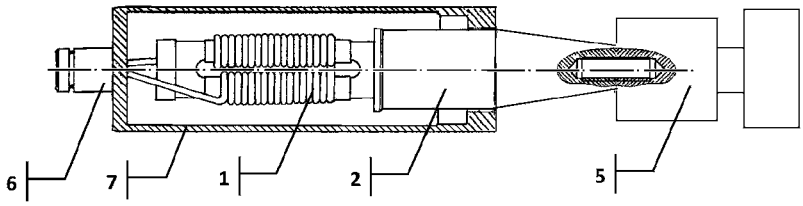
FIG. 1—schematic layout of a downhole ultrasonic scraper.

Downhole ultrasonic scraper consists of the following main parts (FIG. 1, 2): converter (1) of electrical oscillations into mechanical oscillations, wherein the converter in an embodiment of the technical solution can be made of magnetostrictive or piezoelectric type; oscillation transformer (2) and the ultrasonic transducer, wherein the ultrasonic transducer in an embodiment of the claimed technical solution can be made in the shape of a mushroom (3), or in the shape of a bell (4) or in the shape of a short cylinder (5).

Figure 2:
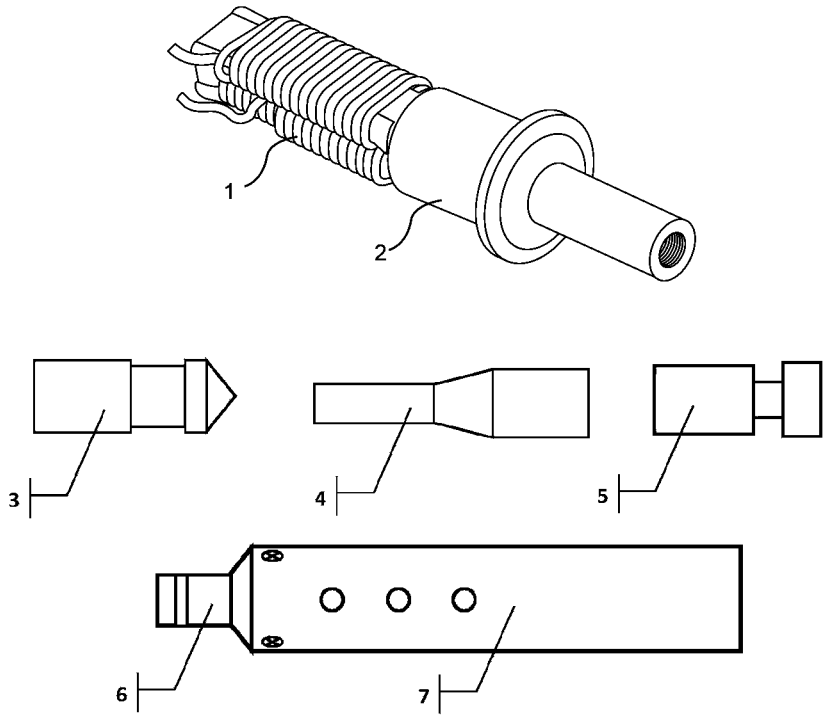
FIG. 2—components of a downhole ultrasonic scraper.
Figure 3:
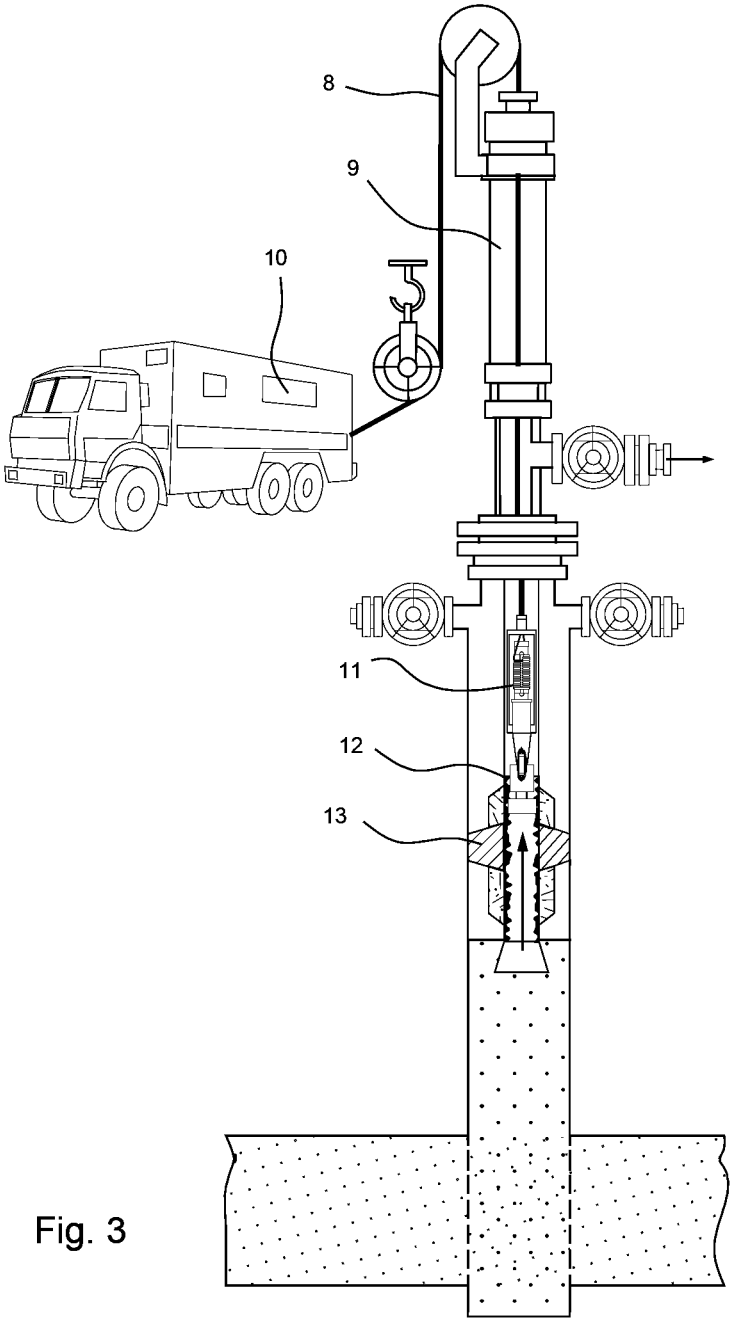
FIG. 3—layout drawing of the complex for ultrasonic tubing cleaning, additional equipment and facilities.

Depending on the predominant type of pipe clogging (asphalt-resin, paraffins, scale, hydrates) there are used ultrasonic transducers of different shapes (FIG. 2): mushroom (3), bell (4) or short cylinder (5).

Ultrasonic transducers in the shape of a mushroom are used to clean pipes from ARPD and calcium salts, since the mushroom shape provides a deviation of the ultrasound radiation in the radial direction, which provides the effect of ultrasonic waves on the tubing and promotes active exfoliation of ARPD and calcium salts from its surface.

Transducers in the shape of a bell are used for cleaning of hydrates, as the sharp edges of the bell in contact with hydrates more actively break them.

The shape of a short cylinder of the transducer is used for paraffin cleaning, because it increases the intensity of radiation in the radial direction and, therefore, makes a greater increase in temperature, which makes the paraffin melt.

To protect converter (1) from mechanical influences there is casing (7), made with holes, which provide the cooling of converter (1) by the flow of the incoming liquid. To casing (7) there is attached tip (6) for connection with the cable lug of geophysical cable (8).

Converter (1) is rigidly attached to the oscillation transformer (2) by means of soldering or welding. Ultrasonic transducer (3 or 4 or 5) is fixed to the oscillation transformer with a thread to ensure quick replacement. The ultrasonic transducer is a source of ultrasonic waves. Also, the ultrasonic transducer produces axial mechanical oscillations, carrying out the impact effect of the casing on the ARPD.

To protect the downhole ultrasonic scraper from overheating there is a temperature sensor placed inside the housing that supplies a signal for turning off the power of the downhole ultrasonic scraper and issuing the corresponding information to the display of the generator.

Oscillation transformer (2) is designed to increase the amplitude of oscillations of ultrasonic transducers. The resonant length of the oscillation transformer of the exponential shape is calculated by the formula:

$$I_p = C/2f(1+(\ln N/\pi)^2)^{1/2},$$

where $I_p$ is the resonant length of the transformer,
C is the sound speed in the material of the waveguide,
f—frequency of ultrasonic oscillations,
$N=k_v$—gain ratio.

Depending on the tubing diameters of DUS is made of different sizes:

1. 1 kW power with an ultrasonic transducer with a diameter of 50, 60 or 80 mm.
2. 3 kW power with an ultrasonic transducer with a diameter of 80, 90 mm.
3. 5 kW power with an ultrasonic transducer with a diameter of 110, 150 mm.

For the application of CUPC in a well a conventional logging hoist is used, in which the generator is placed.

The method of tubing cleaning with CUPC is as follows. Ultrasonic generator (10) is connected to the downhole ultrasonic scraper via geophysical cable (8) wound on the drum of a logging hoist. Downhole ultrasonic scraper is put through the borehole sealer of lubricator (9) an is lowered on the cable through the tubing (12) (or the casing string) to the place of clogging which is determined by weakening of the cable tension. Turning on the ultrasonic generator will start the cleaning of the inner surface of the pipe by providing the combined effect of DUS (11) (ultrasonic, mechanical, thermal) on the clogging. Cleaning is being carried out until the cable tension stops weakening, which suggests that further section of the pipe is clean. Also, end of the treatment can be determined by the length of the geophysical cable run in the hole, which allows to determine the reach of the end of the tubing.

Due to the fact that the well is running, clogging materials crushed by the combined effects (asphaltenes, resins, paraffins, hydrates, calcium salts, etc.) rise to the surface and are extracted from the well by a fluid flow. By so doing the cleaning of the tubing is done.

The claimed technical result is ensured by, firstly, the integrated effects on the clogging: contact effect—due to fluctuations of the emitting device head, ultrasonic effect—due to the use of ultrasound, and heat effect—by converting ultrasonic radiation of high intensity into the thermal effect. Such impact allows to achieve maximal purity of the processed surface of the tubing and casing, including large thickness and hardness of deposits.

Secondly, due to the fact that ongoing oil production contributes to the extraction of mud, which as a result not clogging the sump and is not again precipitated on the surface of the tubing.

Thirdly, the cost reduction takes place due to the elimination of extraction operations and the subsequent descent of the tubing, and through a compensation of some costs due to the ongoing production of oil in the process of treatment.

During the emission of ultrasound, the transducer itself oscillates. These oscillatory movements are of a small amplitude and are not noticeable visually, but they have a high energy impact. Upon the contact of the transducer with paraffin, hydrate and scale deposits it provides a high frequency impact, which contributes to their destruction.

Ultrasonic treatment in the frequency range (15-30 kHz) has a destructive influence on the ARPD, hydrates, scales and other clogging materials. Ultrasonic effect in this frequency range ensures complete detachment of the clogging from the surface of the pipes, creating a clean and smooth surface without any residues which could contribute to the rapid deposition of ARPD, etc. on them.

By calculations and experiments it has been proven that in case of the intensity of ultrasonic radiation more than 0.1 W/cm2 a part of the mechanical energy is converted into heat. The thermal energy promotes softening and dissolution in the fluid of asphalt-resinous and especially paraffin deposits. For example, when using the ultrasonic transducer in the shape of a short cylinder, the radiation intensity is 30 W/cm2. Such intensity increases ARPD temperatures for 20-30° C. depending on the composition of deposits.

An Example of a Specific Implementation of the Method

The major part of ARPD are paraffins. Usually the term "paraffins" unite entire hydrocarbon portion of the sediments consisting of paraffins and ceresins. The composition of petroleum waxes and ceresins includes alkanes with number of carbon atoms greater than 16, which are solids.

Well No. 31 of Solockoe oilfield was producing oil with the paraffin content of 33.2%, resins—3.7%, asphaltenes—1.2% and mechanical impurities of 0.1%. ARPD of such composition starts to crystallize at temperatures less than 60° C. In the well at a depth of 3300 meters, the oil temperature is about 130° C. and almost linearly decreases with decreasing depth. At depths less than 1000 meters the temperature of the oil is reduced below 60° C. and the precipitation of ARPD begins. Therefore, ARPD sediments occur on the tubing length of almost 1000 meters. Cleaning of ARPD deposits was produced by thermal method—the reverse pumping of oil heated up to 80° C. As a result, the daily oil production rate increased from 12.5 $m^3$ up to 20 $m^3$. The frequency of treatment was once a week, and downtime of the well for dewaxing was about 10 hours for a single operation. The total duration of the procedure was 18 hours. After the treatment by ultrasonic scraper oil production began to achieve up to 23 m3 and the cleaning period was 1 month. The cleaning speed was 12 m/hour, the job duration was 3.5 days, but the well cleaning was performed without stopping the well flow.

REFERENCES

1. Patent No. RU 2312206, Device for oil well flow string cleaning of paraffin, piston and scraper included in the device (variants), 2006
2. Patent No. RU 2454529, Method for dewaxing of oil wells tubing, 2010
3. Patent No. RU 2454530, Method for dewaxing of oil wells tubing, 2010
4. Patent No. RU 2495232, Method of flow column cleaning from asphalt-tar-paraffin deposits, 2012
5. Patent No. RU 2495995, Device for cleaning tubing string of oil wells from paraffin, 2012
6. Patent No. RU 2498049, Device for cleaning of inner surface of tubing string, 2012
7. Patent No. RU 2506412, Method and device for cleanout of pipeline inner surface, 2011
8. Patent No. RU 2524581, Pipe inner surface cleaner, 2013
9. Patent No. RU 2527549, Device for cleaning of inner surface of tubing (versions), 2013

The invention claimed is:

1. A method for cleaning pump-and-compressor tubing from asphalt-resin-paraffin deposits and hydrates in a running well, comprising:

lowering a downhole ultrasonic scraper down to a point of clogging in the running well, wherein the scraper is connected by means of a geophysical cable to a ground-based ultrasonic generator, and lowering is performed by means of a logging hoist through a borehole sealer or lubricator;

activating the ultrasonic generator and carrying out a combined triple ultrasonic, heat and contact action on the asphalt-resin-paraffin deposits and hydrates, wherein the contact action on the asphalt-resin-paraffin deposits and hydrates is performed via shock vibrations by an ultrasound transducer with a frequency of 15-30 kHz, the ultrasonic and heat impact on the asphalt-resin-paraffin deposits and hydrates is carried out with an intensity of more than 0.1 W/cm2;

continuing oil production and extracting the asphalt-resin-paraffin deposits and hydrates from the running well by a fluid stream.

2. The method according to claim 1, characterized in that the point of clogging is determined by slackening of the geophysical cable during the process of lowering the downhole ultrasonic scraper.

3. A device for a combined cleaning of pump-and-compressor tubing from asphalt-resin-paraffin deposits, comprising a ground-based ultrasonic generator, a logging hoist, a downhole ultrasonic scraper connected by a geophysical cable to the ground-based ultrasonic generator, wherein the downhole ultrasonic scraper contains a converter of electrical oscillations into mechanical oscillations, an oscillation transformer connected to said converter of electrical oscillations into mechanical oscillations, an ultrasonic transducer, connected to said oscillation transformer, wherein the converter of electric oscillations is mounted inside a protective casing made with holes, and a temperature sensor is placed under said protective casing.

4. The device according to claim 3, characterized in that the converter of electrical oscillations into mechanical oscillations is of a piezoceramic type.

5. The device according to claim 3, characterized in that the converter of electrical oscillations into mechanical oscillations is of a magnetostrictive type.

6. The device according to claim 3, characterized in that the ultrasonic transducer is connected to the oscillation transformer by means of a threaded connection.

7. The device according to claim 3, characterized in that the ultrasonic transducer is made in the shape of a mushroom.

8. The device according to claim 3, characterized in that the ultrasonic transducer is made in the shape of a bell.

9. The device according to claim 3, characterized in that the ultrasonic transducer is made in the shape of a short cylinder.

10. The device according to claim 3, characterized in that the downhole ultrasonic scraper is made with a power of 1 kW and a diameter of the ultrasonic transducer of 50 mm.

11. The device according to claim 3, characterized in that the downhole ultrasonic scraper is made with a power of 3 kW and a diameter of the ultrasonic transducer of 80 mm.

12. The device according to claim 3, characterized in that a downhole ultrasonic scraper is made with a power of 5 kW and a diameter of the ultrasonic transducer of 110 mm.

* * * * *